United States Patent [19]

Rogen

[11] 4,018,547

[45] Apr. 19, 1977

[54] PUMPING BY WIRE ELONGATION

[76] Inventor: Neil E. Rogen, 3 Beaver Dam Road, Upper Saddle River, N.J. 07458

[22] Filed: Aug. 28, 1975

[21] Appl. No.: 608,504

[52] U.S. Cl. ..... 417/321; 417/545

[51] Int. Cl. ..... F04B 17/00

[58] Field of Search ..... 417/52, 321, 260, 322, 417/545, 328; 73/339 R

[56] References Cited

UNITED STATES PATENTS

| | | | |
|---|---|---|---|
| 767,454 | 8/1904 | Taylor | 417/260 |
| 2,317,166 | 4/1943 | Abrams | 417/322 |
| 2,838,007 | 6/1958 | Johnston | 417/545 |
| 2,842,067 | 7/1958 | Stevens | 417/322 |
| 3,483,748 | 12/1969 | Rogen et al. | 73/339 R |
| 3,547,083 | 12/1970 | Pet erson | 417/328 |

*Primary Examiner*—William L. Freeh
*Attorney, Agent, or Firm*—Jerry Cohen; Charles Hieken

[57] ABSTRACT

Pumping in oil wells and like application is carried out in a noiseless manner with efficient utilization of energy by raising the plunger or piston in a subsurface pump piston with a long metal rod or cable capable of undergoing memory shape change as a function of a martensitic transformation when worked by application of stress, preferably by gravity through an attached weight, while cold to elongate itself and, upon application of heat thereto, reversing the transformation and contracting in length to raise the piston and associated equipment plus fluid load.

7 Claims, 2 Drawing Figures

PUMPING BY WIRE ELONGATION

BACKGROUND OF THE INVENTION

The present invention relates to oil well pumping and like applications and is particularly characterized by the carrying out of such pumping in a noiseless manner with high efficiency in utilization of energy and reduced vulnerability to breakage.

Some 85% of oil wells use driven motor pumps to raise oil from deep sub-surface pools to ground level and of these some 85% are sucker rod pumps. Sucker rod pump equipment comprises a tube bottoming out in a dish with a standing valve. Within the tube is piston comprising a valve therein also known as a traveling valve. Ths piston is connected to a ground level prime mover by a longitudinal array of end-to-end connected sucker rods, i.e., a sucker rod string. The prime mover drives the piston up and down within the tube. On up-strokes of the piston oil passes through the standing valve into the tube and on downstrokes of the piston, oil passes through the piston valve to the topside of the piston to become part of the column of oil on the piston raised on every up-stroke to dump a top of the column into collection equipment.

Sucker rod pump equipment is widely used despite recognition of undesirably high noise, cost, weight, driving energy requirements and vulnerability to breakage. The massive above ground equipment associated therewith is also esthetically undesirable. In very deep wells the sucker rod string is tapered or straight, the sucker rod diameter occupies a high proportion of tube diameter thereby creating high friction losses and wear and limiting throughput for given tube diameter and stroke length, both of which are limited as a practical matter.

It is an important object of the invention to overcome one or more of the above drawbacks.

It is a further object of the present invention to provide an improvement in pumping in oil wells and other applications which avoids the above-ground motor and mechanical transmission and their associated cost and noise, friction and mechanical breakdown vulnerabilities, consistent with the preceding object.

It is a further object of the invention to increase stroke length consistent with one or more of the preceding objects.

It is a further object of the invention to reduce cost consistent with one or more of the preceding objects.

It is a further object of the invention to increase piston diameter consistent with one or more of the preceding objects.

It is a further object of the invention to reduce wear consistent with one or more of the preceding objects.

It is a further object of the invention to reduce the vulnerability to breakage of the line within the well consistent with one or more of the preceding objects.

It is a further object of the invention to provide a long life, reliable pumping apparatus consistent with one or more of the preceding objects.

It is a further object of the invention to provide precise control of stroke consistent with one or more of the preceding objects.

SUMMARY OF THE INVENTION

A long rod or cabled wire bundle of shape memory metal is run down the length of the well to be pumped. Shape memory metals are described in my prior U.S. Pat. Nos. 3,440,997, 3,483,752, 3,483,748 (assigned to Avco Corp., Cincinnati, Ohio) and in my co-pending application, Ser. No. 508,224 now abandoned filed Sept. 24, 1974, assigned to Nicoa Corporation of Ridgewood, N.J., and include TiNi, an intermetallic compound known for its shape memory effect associated with its martensitic transformation at around room temperature. The following discussion of that material (also known as 55-NITINOL) should be taken as exemplary since other martensitic transformation materials may be similarly evaluated in the context of the present invention. At a temperature below their TTR (Transition Temperature Range) the 55- Nitinol alloys (and the like) are highly ductile and may be plastically deformed. At a low stress of between 10 to 20 KSI, this results in about 8% deformation (strain). This initial plastic flow in 55-Nitinol is associated with "martensitic shear" or "diffusionless" transformation. This mechanism in a simplified sense is much like applying a shearing force to a aligned deck of playing cards. Each card is made to slide slightly out of alignment with its immediate neighboring card. In the case of a martensitic shear transformation this total atomic movement between adjacent planes of atoms is less than a full interatomic distance, based upon normal atomic lattice arrangement. Raising the temperature above the TTR causes the formation of strong, energetic and directional electron bonds that pull the displaced atoms back to their predeformed positions.

The mechanical memory of this material is easily demonstrated by plastically deforming an annealed wire or sheet or rod of NiTi below its TTR and then heating it, whereupon it will revert to its original shape. This unusual behavior is attributed to a reversible low temperature diffusionless (martensitic type) transformation. There is much disagreement on exact mechanism. But, for the present, suffice it to say that a phase that is stable or metastable above the $M_s$ temperature can transform to a martensitic-type phase at temperatures below $M_s$. Transformation below $M_s$ occurs both athermally (on cooling) and by plastic deformation. It appears that the grains that transform athermally do not contribute to the shape memory effect.

Shape memory apparently comes about as a result of the formation of the acicular phase by deformation of the metastable retained higher-temperature phase. When 55-Nitinol is plastically deformed at a temperature near or below the $M_s$ point the retained phase is transformed into the acicular product. The "memory" arises from the fact that, upon heating (above the $A_s$ point) the oriented grains of acicular phase transform in the reverse direction and assume their original shapes, thus the mechanical plastic deformation is annihilated and the sample returns to the shape it had prior to deformation.

The elongated rod or cable may be stretched by a weight attached to its lower end such as a piston of a type commonly used in oil well pumping, such weight causing the cold wire to undergo martensitic transformation and accompanying elongation on the order of up to 8 percent, preferably about 5 percent to allow a margin of safety within the range of reversibility. The piston may be of conventional design and the elongated member is preferably a cable of several hundreds 20-mil wires but may comprise an equivalent in rod form. Typically, the lengths of the rod or cable would be several hundred or even several thousand feet. Such material, after induction of matensitic transformation therein by mechanical working can undergo a reversal of such transformation by increases of temperature, which may be accomplished through induction heating or direct resistance heating or heating a heating element such as nichrome wire which is bundled in a cable of matensitic transformation material or simply wrapped around a rod or cable of martensitic transformation material or the heat of the oil well. Cooling can be used to induce the martensitic transformation and may be accomplished by flowing liquid coolant along the wire or cable or through Peltier effect refrigeration or by the temperature of the oil in the well.

Other objects, features and advantages of the invention will be apparent from the following detailed description of preferred embodiments taken in connection with the accompanying drawing in which:

DETAILED DESCRIPTION OF PREFERRED EMBODIMENTS

Figure 1:
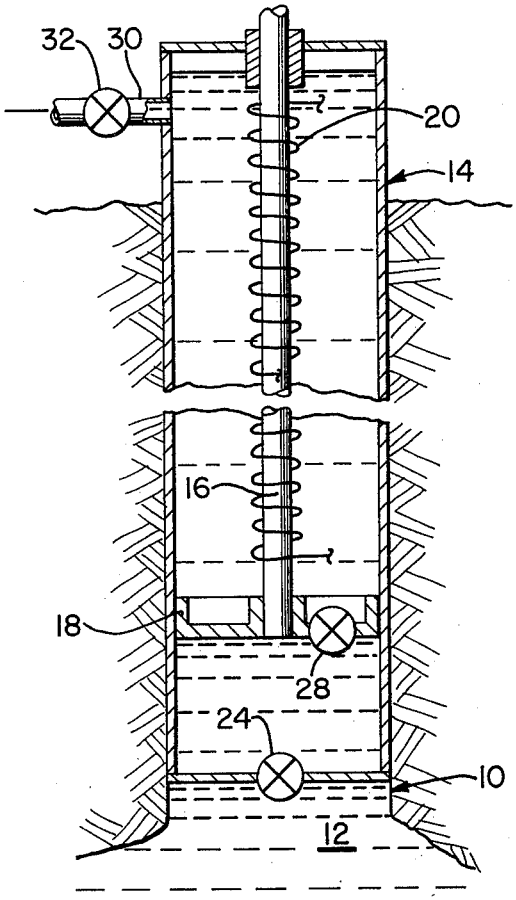
FIGS. 1 and 2 are schematic views of a pumping apparatus according to two preferred embodiments of the invention.

Referring now to FIG. 1 of the drawing, there is shown an oil well tunnel 10, oil 12 therein and a tube 14 containing an elongated cable 16 carrying a piston 18. A heating circuit 20 provides in direct resistance heating to the cable to force contraction.

The tube 14 contains a valve 24 in its base and the piston 18 contains a valve 28 therein. On up-strokes of the piston the column of oil of length L on top of the piston is raised to dump into line 30 for withdrawal via valve 32. At the same time oil in pool 12 forces part valve 24 to enter the chamber defined at 22. On down-stroke oil in chamber 22 forces part valve 28 to move to the top side of the piston.

The down-stroke is provided by gravity force of the piston weight stretching cable 16 and thereby, inducing martensitic transformation. Up-stroke is accomplished by circuit 20 passing resistance heating current through cable 16 to reverse the martensitic transformation to induce shape memory contraction of cable 16 to its original length.

EXAMPLE 1

A prototype model of pumping apparatus in accordance with the above-described embodiment but without valves and using instead of a piston a simple bucket dipping into a pool was constructed using a five foot length of 20 mil diameter Nitinol-55 wire and a 12 pound bucket extended over a pool of water. The weight of the bucket caused the wire to elongate and undergo martensitic transformation to dip into the water. Then a 12 volt battery was placed in circuit across the ends of the wire to provide direct heating and raise the bucket full of water and then weighing 20 pounds out of the water, the total length of stroke being about 2–3 inches. This elongation/contraction cycling was repeated over several dozen cycles without any noticeable creep effects or other incipient irreversible phenomena setting in.

It can be seen that the above described apparatus meets the above stated objects and can overcome the above limitations of conventional sucker rod pumps.

Another limitation of sucker rod design eliminated by the present invention is that the outside diameter of the sucker rod is designed to provide clearance for passage of fluid up through the tubing to surface. The larger the diameter of sucker rod lesser is the clearance between rod and production string or tubing. Cables or rods of transformation material have very small diameter, i.e., greater clearance between the tube and the connecting rod or cable connection.

Maximum life of a pump is directly related to the minimum pumping speeds. Reducing cyclic speeds and increasing stroke allows greater wear at the same throughput. The present invention permits very long strokes at slow speeds for greater pumping capacity and low wear. Typical bores of conventional pumps vary from 1–4¾ inches and their stroke varies from a few inches to about thirty feet (from model to model). The present invention could be applied for instance to a 1,000 foot long cable (being the total depth of pumping or only a fraction of depth — the balance of cable length being steel or other non-transformation material) with an elongation of 5% on each gravity stretch down-stroke for a 50 foot stroke. Even longer strokes could be made.

The weight of the piston (and/or auxiliary weights) connected to the piston and/or cable may be supplemented by mechanical or hydraulic spring means (loaded on up-strokes and releasing energy on down-strokes) to provide the necessary force for down-strokes without resort to prime movers or excessive parasitic weight to be handled up and down.

Figure 2:
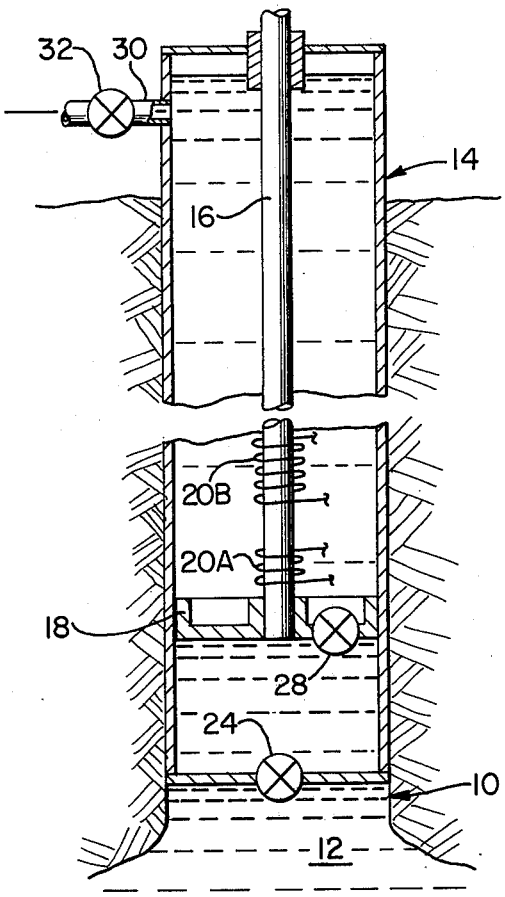

A further method of supplementing down-stroke drive by piston weight is illustrated in FIG. 2 and involves use of weight of the fluid column. In this embodiment, parts similar to those of FIG. 1 are similarly numbered. The significant difference is that two separate sections are heated by indirect resistance heaters 20A and 20B (or alternatively direct heaters). A first relatively short section 20A is heated to induce a short auxiliary up-stroke while causing closing of valve 28. Then down-stroke motion will proceed under the weight of the liquid column on top of piston 18, even though valve 28 automatically reopens in the course of the down-stroke. The main up-stroke is induced by powering heater 20B.

Alternatively heaters 20A and 20B may be replaced by a single heater heating a common length, or the full length of cable 16 at two different temperature levels. The auxiliary up-stroke length is typically 1/10 – 1/5 of the length of main up-stroke length.

While a preferred cable or rod material for purposes of the present invention comprises equiatomic nickel-titanium, other materials may be employed, including gold-cadmium, indium-thallium, nickel aluminide, element cobalt or titanium or zirconium and the further binary alloys, iron-nickel, copper-aluminum and cobalt-nickel.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Sucker rod type comprising, means defining a pumping piston member for cyclically engaging a liquid pool and transferring liquid from one face of the piston to an opposite face to produce a liquid column on top of the piston member, means defining an elongated martensitic transformation member of at least one hundred feet length carrying and suspending said piston member, means defining a down-stroke driver for elongating said martensitic transformation material by about 5% and inducing said transformation at a first relatively cold temperature, and means for heating said martensitic material to reverse the transformation and automatically reverse said elongation lifting the liquid column, to provide lowering and raising portions of a pumping cycle.

2. Pumping apparatus in accordance with claim 1 wherein the heating means comprise means for direct electrical resistance heating of the martensitic material.

3. Pumping apparatus in accordance with claim 1 wherein the heating means comprise electrical resistance means indirectly heating the martensitic material.

4. Pumping apparatus in accordance with claim 1 wherein the down-stroke drive means comprises the piston weight.

5. Pumping apparatus in accordance with claim 1 wherein the down-stroke drive means comprise the weight of the liquid column.

6. Pumping apparatus in accordance with claim 1 wherein the down-stroke drive means comprise a combination of solid weight elements, including said piston, and said liquid column carried by said piston.

7. Sucker rod type pumping apparatus comprising, an elongated martensitic transformation member forming a portion of an elongated vertically hanging line, a piston with top and bottom side hanging at the end of the line, valve means for transferring liquid from one side of the piston to the other in response to piston motion, the piston being effective to stretch the martensitic transformation material through gravity descent, means for heating the martensitic transformation to reversibly counteract the stretching to raise the piston, means for establishing a liquid column top side of the piston when liquid is transferred from the bottom side to top side so that the column is raised when the piston is raised, and means for drawing liquid off from the raised column.

* * * * *